United States Patent [19]

Feneberger et al.

[11] 4,052,323

[45] Oct. 4, 1977

[54] HIGH-TEMPERATURE LUBRICANT FOR THE HOT-WORKING OF METALS

[75] Inventors: Kurt Feneberger; Rolf Gely, both of Sins, Switzerland

[73] Assignee: Lonza, Ltd., Gampel, Valais, Switzerland

[21] Appl. No.: 523,499

[22] Filed: Nov. 13, 1974

[30] Foreign Application Priority Data

| | | |
|---|---|---|
| May 8, 1974 | Switzerland | 006242/74 |
| Sept. 6, 1974 | Switzerland | 012127/74 |

[51] Int. Cl.[2] ..... C10M 3/18

[52] U.S. Cl. ..... 252/23; 72/42; 252/22; 252/49.5

[58] Field of Search ..... 72/42; 252/29, 30, 52 R, 252/49.5, 22, 23

[56] References Cited

U.S. PATENT DOCUMENTS

| | | | |
|---|---|---|---|
| 1,944,273 | 1/1934 | Rutherford | 252/22 X |
| 2,176,879 | 10/1939 | Bartell | 44/51 |
| 3,213,024 | 10/1965 | Blake et al. | 252/22 X |
| 3,242,075 | 3/1966 | Hunter | 252/22 |
| 3,341,454 | 9/1967 | Chor et al. | 252/22 |
| 3,384,580 | 5/1968 | Peace | 252/29 |
| 3,384,581 | 5/1968 | Peace | 252/30 |
| 3,801,504 | 4/1974 | Stone | 252/49.5 |
| 3,806,453 | 4/1974 | McDole | 252/22 |
| 3,806,453 | 4/1974 | McDole | 252/49.5 |

*Primary Examiner*—Delbert E. Gantz
*Assistant Examiner*—Andrew H. Metz
*Attorney, Agent, or Firm*—Virgil H. Marsh

[57] ABSTRACT

The high-temperature lubricant for the hot-working of metals which comprises (a) 10 to 90 percent by weight of graphite, (b) 2 to 45 percent by weight of an alkylene homopolymer or copolymer, and (c) 0.5 to 8 percent by weight of a dispersing agent. The lubricant is solid at room temperature. The high-temperature lubricant is applied in the form of an aqueous solution which includes 5 to 80 percent by weight of the solid high-temperature lubricant. The process of production and use of the high-temperature lubricant.

The high-temperature lubricant for the hot-working of metals which comprises (a) 35 to 90 percent by weight of graphite, (b) 2 to 60 percent by weight of an alkylene homopolymer or copolymer, (c) 0.2 to 8 percent by weight of an auxiliary suspension agent, and (d) 2 to 40 percent by weight of a film stabilizer. The lubricant is applied in the form of an aqueous solution which includes 5 to 80 percent by weight of solid lubricant. The lubricant is used at temperatures of around 900° C. or higher.

31 Claims, No Drawings

HIGH-TEMPERATURE LUBRICANT FOR THE HOT-WORKING OF METALS

BACKGROUND OF THIS INVENTION

1. Field of This Invention

This invention relates to a high temperature lubricant for the hot-working of metals, its production and usage.

2. Prior Art

It is known to use mixtures of graphite and oil. When such product is used, a decomposition of the oil takes place, which not only has a disadvantageous effect on the material characteristics of the tool and of the workpieces, but also leads to undesirable emissions into the environment.

It has been proposed to use a precisely defined mixture of alkali sulfate, borax, potassium chloride, sodium triacetate and graphite, possibly together with further additives in the form of an aqueous dispersion, as a high temperature lubricant for the non-cutting conversion of metal (see German Pat. No. 2,046,727). Such is no good for use with metals in hot-working as a liquid melt is necessary.

A high temperature lubricant for the purpose of the hot-working of metals is known which is produced from a melted product of phosphates and borates of the alkali metals and possible of zinc and/or aluminum and an addition of further components. (See German Pat. No. 2,154,232.) Such a lubricant has problems. A solid lubricant, consisting mainly of graphite or tungsten disulfide and sodium fluoride has been proposed, and is used in the form of a paste (see German Pat. No. 2,028,804.) Salt melts, too, do not always completely satisfy the need of the art, especially in case of the production of seamless piper on so-called pilgrim rolling trains or "Konti" trains.

In the case of such known high-temperature working processes, very high temperatures develop as a result of which the viscosity of such melts drops to a point that the bearing capacity of the lubricant film no longer guarantees sufficient lubrication.

BROAD DESCRIPTION OF THIS INVENTION

It is an object of this invention to provide a high-temperature lubricant for the hot working of metals which has sufficient bearing capacity in the lubricant film during use to effect sufficient lubrication at such high temperatures. It is also an object of this invention to provide an aqueous suspension of such high-temperature lubricant. It is further an object of this invention to provide a process for preparing such high-temperature lubricant and aqueous suspension thereof. It is still further an object of this invention to provide novel results when such high-temperature lubricant and aqueous suspension thereof are used.

It is further an object of this invention to provide a high-temperature lubricant for the hot-working of metals which is stable at temperatures of around 900° C.

Other objects and advantages of this invention are set out in this specification and claims or are obvious to one ordinarily skilled in the art.

These objects and advantages are achieved by this invention.

The first embodiment of this invention includes a high-temperature lubricant for the hot-working of metals which includes (a) 10 to 90 percent by weight of graphite, (b) 2 to 45 percent by weight of an alkylene homopolymer or copolymer and (c) 0.5 to 8 percent by weight of a dispersion agent. The lubricant being solid at room temperature. The graphite is in particle form. The graphite preferably has a particle size of up to 300 μm and a purity of at least 96 percent, and most preferably has a particle size of about 100 μm and a purity of about 99.5 percent. Preferably the alkylene homopolymer or copolymer is a vinyl acetate copolymer or a mixture of a vinyl acetate homopolymer and a dibutyl maleinate homopolymer, or a copolymer of vinyl acetate and ethylene. Preferably the dispersing agent is a polysaccharide.

The high-temperature lubricant is applied to the metal to be hot worked in the form of an aqueous suspension. The aqueous suspension which includes 5 to 80 percent by weight of the solid high-temperature lubricant. Preferably the aqueous suspension contains a minor quantity of a wetting agent.

This embodiment includes the process of producing the above-described suspension of high-temperature lubricant which includes preparing an aqueous suspension of the alkylene homopolymer or copolymer and the dispersing agent, and inserting said graphite into the aqueous suspension.

This embodiment includes the process of using the aqueous suspension containing the high-temperature lubricant for the lubrication of metals during the hot-working of the metals. Preferably the aqueous suspension of the high-temperature lubricant is used for lubricating the mandrel during the production of seamless pipe.

The high-temperature lubricant of the first embodiment of this invention is particularly suited for use in the hot-working of metals. It is especially suited for lubricating a mandrel during the production of seamless pipes. However, when such high-temperature lubricant is used, for example, on pass rolling mills, the film of such lubricant is not sufficiently stable at temperatures of around 900° C. The high-temperature lubricant of the second embodiment of this invention is sufficiently stable at temperatures of around 900° C.

The second embodiment of this invention includes a high-temperature lubricant for the hot-working of metals which includes (a) 35 to 90 percent by weight of graphite, (b) 2 to 60 percent by weight of an alkylene homopolymer or copolymer, (c) 0.2 to 8 percent by weight of an auxiliary suspension agent, and (d) 2 to 40 percent by weight of a film stabilizer. The lubricant is solid at room temperature. Preferably the film stabilizer is a boron oxide, a sodium silicate, a silicic acid, a metal phosphate or a combination of one or more of the aforegoing enumerated materials. Most preferably the film stabilizer is sodium silicate or colloidal silicic acid. Preferably the auxiliary suspension agent is a polysaccharide. A small quantity of an oxidation inhibitor and/or a microbiological auxiliary substance can be present. Preferably the alkylene homopolymer or copolymer is polyisobutylene or a copolymer of acrylic acid and styrene. The graphite is in particle form. The graphite preferably has a particle size of up to 300 μm and a purity of at least 96 percent, and most preferably has a particle size of about 100 μm and a purity of about 99.5 percent.

The high-temperature lubricant is applied in the form of an aqueous suspension. The aqueous suspension which includes 5 to 80 percent by weight of the solid high-temperature lubricant. Preferably the aqueous suspension contains a minor quantity of a wetting agent.

This embodiment includes the process of producing the above-identified aqueous suspension of high-temperature lubricant which includes preparing a dry admixture of the alkylene homopolymer or copolymer, the graphite, the film stabilizer and the dispersing agent, and suspending the dry admixture in water.

This embodiment includes the process of using the aqueous suspension containing the high-temperature lubricant for the lubrication of metals during the hot-working of the metals, basically for non-cutting conversion of metals. Preferably the aqueous suspension of said high-temperature lubricant is used for lubricating pass rolling mills (where temperatures of around 900° C or higher are incurred — yet the lubricant film formed by the lubricant of this invention is stable and effective).

DETAILED DESCRIPTION OF THIS INVENTION

Concerning the first embodiment of this invention, the following detailed disclosure is presented.

The graphite is in particle or grain form. Preferably the graphite has a particle size of up to 300 μm and a purity of at least 96 percent. Most preferably the graphite has a particle size of about 100 μm and a purity of about 99.5 percent.

The alkylene homopolymer or copolymer is a solid material at room temperature. The alkylene homopolymer or copolymer are usually produced by an emulsion-polymerization process.

The term alkylene homopolymers and copolymers, as used herein, includes homopolymers and copolymers of arylalkenes, $\alpha,\beta$-unsaturated acids and esters, $\beta,\gamma$-unsaturated acids and esters, alkenes (monoolefins, diolefins, etc.), vinyl esters, unsaturated dibasic (dicarboxylic) acids and esters, alkyl esters, and acrylic acid and esters. The alkylene homopolymer or copolymer can be polyethylene, poly(methyl methacrylate), polystyrene, polybutadiene, poly(vinyl acetate), poly(vinyl laurate), poly(vinyl propionate), copolymer of methyl methacrylate and styrene, copolymer of methyl methacrylate and alpha-methyl-styrene, poly(dially phthalate), polypropylene, copolymer of styrene and butadiene poly(-methyl acrylate), copolymer of vinyl acetate and ethylene and polyisobutylene. Mixtures of the alkylene homopolymers and copolymers can be used.

The dispersing agent is a solid at room temperature and is generally insoluble in water.

The dispersing agent (or suspending agent) can be a polysaccharide such as, starch, cellulose, inulin, glycogen, agar, levan, lichenin, pectin, lignin and araban. The dispersing agent can be an alkyl cellulose, such as, methyl cellulose, ethyl cellulose, propyl cellulose and butyl cellulose. The dispersing agent can be an alginate, such as, sodium alginate, potassium alginate, propylene glycol alginate and ammonium alginate.

Preferably a minor quantity (up to 0.5 percent) of a wetting agent can be added to the aqueous suspension of the high-temperature lubricant. Examples of wetting agents are alkyl aryl sulfonates, fatty acid amides, fatty acid soaps, substituted amides of alkyl phosphates, sulfonated esters of dicarboxylic acids, sulfonated fatty amides, alkylolamines, sodium alkyl sulfates, aliphatic ester amines, polyethers, sulfonated higher phenols and naphthalene sulfonates.

In order to achieve an optimum lubricating effect, a dry lubricating film must be present. The aqueous suspension containing the lubricant is applied to a hot tool in a known manner, such as, spraying or painting; at the same time the water evaporates and as a result of melting, the homopolymer or copolymer forms a tough viscous film. The thickness of the film amounts effectively to 0.05 to 1.0 mm, preferably to 0.1 to 0.2 mm. In this film the graphite particles on the basis of their structure align themselves in the shape of small flakes over the entire surface. At the beginning of the working process the workpiece so to speak floats or swims on the polymer film. Finally the homopolymer or copolymer burns off, without leaving any residue. The calcination produces a gas cushion which bolsters the separation between the frictional surfaces. At the same time the graphite produces a separating and lubricating layer capable of bearing, which in the case of a local overload and tearing off of the hydrodynamically acting film of the melt caused thereby and particularly in the case of peak temperatures during the process, becomes effective. As a result of the calcination of the polymeric additive, etc., of this invention, one must assume that a kind of protective atmosphere developes between the tool and the workpiece, which delays the calcination of graphite in the case of higher temperatures.

The high temperature lubricant of this invention can be used basically for the non-cutting metal conversion, for example, in drop forging. A preferred usage of the lubricant is on the mandrels in the case of the production of seamless pipes, for example, on so-called pilgrim, Konti or MPM rolling trains. The aqueous suspension of lubricant permits a lubricating film to be sprayed on the mandrel during the return of the mandrel to the surface. Instantaneously a dry water repellant film developes on the hot surface of the mandrel. Immediately after the application of the film the mandrel can be cooled in the water bath or by atomizing water into it without removing the lubricating film. The lubricating film is not damaged by the intensive water cooling of the rolls to which the mandrel is exposed at the beginning of the rolling process. After application of the lubricant certain advantages result as compared to the known lubricants. The lubricants of this invention are physiologically harmless formulation suspended in water and give a clean calcining or roasting (no thick oil smoke inimical to the environment results). The lubricant leaves a shinny surface of the mandrel without residues. The power which is required in order to draw pipes through rolling mills is considerably decreased, the rolling stands operate more effectively and the wear of the mandrel is greatly reduced when the lubricant of this invention is used. The pipe encompasses the mandrel evenly from which a particular quality of pipe results, and it is possible to achieve thinner thicknesses of pipe walls with a certain installation when the lubricant of this invention is used.

Concerning the second embodiment of this invention, the following detailed description disclosure is presented.

The film stabilizer is solid at room temperature.

The film stabilizer can be: a boron oxide, such as, $B_2O_3$; a sodium silicate, such as, sodium silicate (water glass), sodium disilicate, sodium metasilicate and sodium orthosilicate; a silicic acid, such as, disilicic acid and metasilicic acid; or a (metal) phosphate, such as, an alkali phosphate, e.g., lithium metaphosphate, lithium orthophosphate, potassium metaphosphate, potassium orthophosphate, sodium metaphosphate, potassium subphosphate and sodium pyrophosphate, an alkaline earth phosphate, e.g., barium pyrophosphate, barium orthophosphate, calcium pyrophosphate, calcium orthophosphate, calcium metaphosphate, calcium hypophosphate, berylium orthophosphate magnesium orthophosphate, or other metal phosphate, e.g., cobalt orthophosphate, zinc orthophosphate, aluminum orthophosphate, zinc pyrophosphate, cadium orthophosphate, cadmium pyrophosphate, lead orthophosphate, cerium pyrophosphate, bismuth orthophosphate, chromium pyrophosphate, cerium orthophosphate, iron pyrophosphate, iron orthophosphate, manganese pyrophosphate, manganese orthophosphate, nickel pyrophosphate, thallium orthophosphate, platinum pyrophosphate, silver orthophosphate, silver pyrophosphate, nickel orthophosphate, lead pyrophosphate, chromium orthophosphate, manganese metaphosphate, copper orthophosphate, molybdenum metaphosphate, thorium orthophosphate, silver metaphosphate, tin orthophosphate, thallium pyrophosphate, tin pyrophosphate and tin metaphosphate. Combinations thereof can be used as the film stabilizer. The film stabilizers can be incorporated in the aqueous suspension in the form of an aqueous suspension.

The auxiliary suspension agent is a solid at room temperature and is generally insoluble in water.

The auxiliary suspension agent can be polysaccharide such as, starch, cellulose, inulin, glycogen, agar, levan, lichenin, pectin, lignin and araban. The auxiliary suspension agent can be an alkyl cellulose, such as, methyl cellulose, ethyl cellulose, propyl cellulose and butyl cellulose. The auxiliary suspension agent can be an alginate, such as, sodium alginate, potassium alginate, propylene glycol aginate and ammonium alginate. Combinations can be used.

The graphite should be in particle form. Preferably the graphite has a particle size of up to 300 $\mu$m and a purity of at least 96 percent. Most preferably the graphite has a particle size of about 100 $\mu$m and a purity of about 99.5 percent.

The alkylene homopolymer or copolymer is a solid material at room temperature. The alkylene homopolymer or copolymer are usually produced by an emulsion-polymerization process.

The term alkylene homopolymers and copolymers, as used herein, includes homopolymers and copolymers of arylalkenes, $\alpha,\beta$-unsaturated acids and esters, $\beta,\gamma$-unsaturated acids and esters, alkenes (monoolefins, diolefins, etc), vinyl esters, unsaturated dibasic (dicarboxylic) acids and esters, alkyl esters, and acylic acid and esters. The alkylene homopolymer or copolymer can be polyethylene, poly(methyl methacrylate), polystyrene, polybutadiene, poly(vinyl acetate), poly(vinyl laurate), poly(vinyl propionate), copolymer of methyl methacrylate and styrene, copolymer of methyl methacrylate and alpha-methyl styrene, poly(dially phthalate), polypropylene, copolymer of styrene and butadiene, poly(methyl acrylate), copolymer of vinyl acetate and dibutyl maleinate, copolymer of vinyl acetate and ethylene and polyisobutylene. Mixtures of the alkylene homopolymers and copolymers can be used.

Other additives, such as, microbiological auxiliary substances and/or oxidation inhibitors can be admixed in small quantities (up to 0.5 percent each) to the high temperature lubricant of this invention.

The aqueous suspension is preferably prepared from the dry admixture just before usage.

Preferably a minor quantity (up to 0.5 percent) of a wetting agent can be added to the aqueous suspension of the high-temperature lubricant. Examples of wetting agents are alkyl aryl sulfonates, fatty acid amines, fatty acid soaps, substituted amides of alkyl phosphates, sulfonated ester of dicarboxylic acids, sulfonated fatty amides, alkylolamines, sodium alkyl sulfates, aliphatic ester amines, polyethers, sulfonated high phenols and naphthalene sulfonates.

The aqueous suspension containing the lubricant is applied to the hot tool or workpiece effectively in a known manner such as, spraying or painting. The water quickly evaporates and the hompolymer or copolymer forms a tough viscous stable film through melting. The thickness of the film amounts effectively to 0.05 to 1.0 mm, preferably 0.1 to 0.2mm. In this film graphite particles, on the basis of their structure, align themselves in the form of flakes evenly across the entire surface. In the beginning of the working process, the workpiece so to speak floats on the polymer film. Finally, the homopolymer or copolymer neatly deflagrates (vaporizes without any residue). The calcination produces a gas cushion which bolsters the separation between the frictional surfaces. At the same time the graphite produces a load-bearing separating and lubricating layer which becomes effective in case of a local overload and a tearing off of the hydrodynamically acting film of the melt caused thereby (especially at peak temperatures during the process). As a result of the calcination of the lubricant (polymeric components, etc.) of this invention, it is assumed that a sort of protective atmosphere develops between the tool and the workpiece which delays the calcination of graphite when higher temperatures occur.

As used in this specification and claims, all parts, ratios, proportions and percentages are on a weight basis, unless otherwise stated or obvious to one ordinarily skilled in the art.

EXAMPLE 1

Graphite and water were mixed into an aqueous suspension containing 31.1 percent by weight of a vinyl acetate copolymer and 3.3 percent by weight of a polysaccharide. The resultant suspension contained 20 percent by weight of graphite, 9.5 percent by weight of a vinyl acetate copolymer, 1 percent by weight of a polysaccharide and 69.5 percent by weight of water. The aqueous suspension was sprayed onto the mandrel of a MPM rolling train, which served for the production of seamless pipes. Excellent lubrication at the resultant high temperatures was obtained.

EXAMPLE 2

An aqueous dispersion of a vinyl acetate-dibutyl maleinate homopolymer mixture, a polysaccharide and graphite was prepared. The aqueous dispersion contained 12 percent by weight of graphite, 28 percent by weight of a vinyl acetate-dibutyl maleinate homopolymer mixture, 0.5 percent by weight of a polysaccharide and 59 percent of water. The aqueous suspension was applied to the tools and workpieces by spraying and painting. After evaporation of the water, a film of the high temperature lubricant remained on the processed surface. Excellent lubrication at the resultant high temperatures was obtained.

EXAMPLE 3

The components of a high temperature lubricant, 69.4 percent by weight of graphite. 29.7 percent by weight of a ethylene-vinyl acetate copolymer and 0.9 percent by weight of a polysaccharide, were mixed dry. Immediately prior to its use, a suspension of the dry mix was produced with water, whereby the quantity of solid substance was adjusted to 50 percent by weight of the total weight of the suspension. The high temperature lubricant was applied in suspension form to the tools and workpiece by spraying. Excellent lubrication at the resultant high temperatures was obtained.

EXAMPLE 4

A polysaccharide, colloidal silicic acid, an aqueous sodium silicate solution of Be 38/40 and graphite were added to an aqueous dispersion of a polyisobutylene homopolymer. The resultant aqueous suspension contained 20 percent by weight of graphite, 5 percent by weight of a polyisobutylene homopolymer, 4 percent by weight of colloidal silicic acid, 10 percent by weight of the sodium silicate solution, 2 percent by weight of a polysaccharide and 59 percent by weight of water. The aqueous suspension was applied to the workpieces and shaped material. The film stabilizer produced an even, optimally acting lubricating film, even at the customary conversion temperatures used, such as in section rolling, of up to above 900° C.

EXAMPLE 5

The following components are intimately mixed with one another and then dry ground in a powdered form: 59 percent by weight of graphite; 19 percent by weight of an acrylic acid-styrene copolymer; 6 percent by weight of colloidal silicic acid; 13 percent by weight of sodium silicate; and 3 percent by weight of a polysaccharide. The dry mixture was stirred (at the place of use and shortly before its use) into an equal quantity of water, so that an aqueous suspension having a 50 percent by weight solids content resulted. The aqueous suspension was sprayed onto the workpieces and tools, whereby the water evaporated on the hot surfaces and the high temperature lubricant became effective during processing. The lubricant films were exceedingly stable as a result of the use of the film stabilizer, even at high temperatures.

What is claimed is:

1. The high-temperature lubricant for the hot-working of metals which comprises (a) 10 to 90 percent by weight of graphite, (b) 2 to 45 percent by weight of an homopolymer or copolymer selected from the group consisting of polyethylene, poly(methyl methacrylate), polystyrene, poly(vinyl acetate), poly(vinyl laurate), poly(vinyl propionate), a copolymer of methyl methacrylate and styrene, a copolymer of methyl methacrylate and alpha-methyl-styrene, polyisobutylene, poly(-dibutyl maleinate), poly(diallylphthalate), polypropylene, poly(methyl acrylate), a copolymer of vinyl acetate and ethylene, polyisobutylene and mixtures thereof, and (c) 0.5 to 8 percent by weight of a dispersing agent which is selected from the group consisting of a polysaccharide, an alkyl cellulose and an alginate, said lubricant being solid at room temperature.

2. The high-temperature lubricant of claim 1 wherein said graphite is in particle form.

3. The high-temperature lubricant of claim 2 wherein said graphite has a particle size of up to 300 μm and a purity of at least 96 percent.

4. The high-temperature lubricant of claim 2 wherein said graphite has a particle size of about 100 μm and a purity of about 99.5 percent.

5. The high-temperature lubricant of claim 2 wherein component (b) is a vinyl acetate copolymer.

6. The high-temperature lubricant of claim 2 wherein component (b) is a mixture of a vinyl acetate homopolymer and a dibutyl maleinate homopolymer.

7. The high-temperature lubricant of claim 2 wherein component (b) is a copolymer of vinyl acetate and ethylene.

8. The high-temperature lubricant of claim 2 wherein said dispersing agent is a polysaccharide.

9. The high-temperature lubricant of claim 2 wherein said dispersing agent is selected from the group consisting of starch, cellulose, inulin, glycogen, agar, levan, lithenin, pectin, lignin, araban, methyl cellulose, ethyl cellulose, propyl cellulose, butyl cellulose, sodium alginate, potassium alginate, propylene glycol alginate and ammonium alginate.

10. The aqueous suspension comprising from 95 to 20 percent by weight of water and from 5 to 80 percent by weight of said solid high-temperature lubricant of claim 1.

11. The aqueous suspension of claim 10 which conains 20 percent by weight of said graphite, 9.5 percent by weight of vinyl acetate copolymer, 1 percent by weight of a polysaccharide and 69.5 percent by weight of water.

12. The aqueous suspension of claim 10 wherein up to 0.5 percent by weight of a wetting agent is present, said wetting agent is selected from the group consisting of an alkyl aryl sulfonate, a fatty acid amine, a fatty acid soap, a substituted amide of alkyl phosphate, a sulfonated ester of dicarboxylic acid, a sulfonated fatty amide, an alkylolamine, a sodium alkyl sulfate, an aliphatic ester amine, a polyether, a sulfonated high phenol and a naphthalene sulfonate.

13. The process of producing the aqueous suspension of the high-temperature lubricant of claim 10 comprising (a) preparing an aqueous suspension of said homopolymer or copolymer and said dispersing agent, and (b) inserting said graphite into the aqueous suspension of step (a).

14. The process of lubricating metals during hot-working of said metal which comprises contacting the metal workpiece or tool to be hot-worked with the aqueous suspension of claim 10.

15. The process of claim 14 wherein said aqueous suspension of said high-temperature lubricant is used for lubricating the mandrel during the production of seamless pipe.

16. The high-temperature lubricant for the hot-working of metals which comprises (a) 35 to 90 percent by weight of grahite, (b) 2 to 60 percent by weight of an homopolymer or copolymer selected from the group consisting of polyethylene, poly(methyl methacrylate), polystyrene, poly(vinyl acetate), poly(vinyl laurate), poly(vinyl propionate), copolymers of methyl methacrylate and styrene, a copolymer of methyl methacrylate and alpha-methyl-styrene, polyisobutylene, poly(-dibutyl maleinate), poly(diallyl phthalate), polypropylene, poly(methyl acrylate), a copolymer of vinyl acetate and ethylene polyisobutylene, and mixtures thereof, (c) 0.2 to 8 percent by weight of an auxiliary suspension agent selected from the group consisting of a polysaccharide, an alkyl cellulose, an alginate and combinations thereof, and (d) 2 to 4 percent by weight of a film stabilizer selected from the group consisting of boron oxide, a sodium silicate, a silicic acid, a metal phosphate and a combination of one or more of said film stabilizers, said lubricant being solid at room temperature.

17. The high-temperature lubricant of claim 16 wherein said graphite is in particle form.

18. The high-temperature lubricant of claim 17 wherein said film stabilizer is sodium silicate.

19. The high-temperature lubricant of claim 17 wherein said film stabilizer is colloidal silicic acid.

20. The high-temperature lubricant of claim 17 wherein said auxiliary suspension agent is a polysaccharide.

21. The high-temperature lubricant of claim 17 wherein said homopolymer or copolymer is polyisobutylene.

22. The high-temperature lubricant of claim 17 wherein component (b) is a copolymer of acrylic acid and styrene.

23. The high-temperature lubricant of claim 17 wherein said graphite has a particle size of up to 300 μm and a purity of at least 96 percent.

24. The high-temperature of claim 17 wherein said graphite has a particle size of about 100 μm and a purity of about 99.5 percent.

25. The high-temperature lubricant of claim 17 wherein said dispersing agent is selected from the group consisting of starch, cellulose, inulin, glycogen, agar, levan, lichenin, pectin, lignin, araban, methyl cellulose, ethyl cellulose, propyl cellulose, butyl cellulose, sodium alginate, potassium alginate, propylene glycol alginate, ammonium alginate and combinations thereof.

26. The high temperature lubricant of claim 17 wherein said film stabilizer is selected from the group consisting of sodium silicate, sodium disilicate, $B_2O_3$, sodium metasilicate, sodium orthosilicate, disilicic acid, metasilicic acid, lithium metaphosphate, potassium orthophosphate, sodium metaphosphate, potassium subphosphate, sodium pyrophosphate, barium pyrophosphate, barium orthophosphate, calcium pyrophosphate, calcium orthophosphate, calcium metaphosphate, calcium hypophosphate, berylium orthophosphate, magnesium orthophosphate, cobalt orthophosphate, zinc orthophosphate, aluminum orthophosphate, zinc pyrophosphate, cadmium orthophosphate, cadmium pyrophosphate, lead orthophosphate, cerium pyrophosphate, bismuth orthophosphate, chromium pyrophosphate, cerium orthophosphate, iron pyrophosphate, iron orthophosphate, manganese pyrophosphate, manganese orthophosphate, nickel pyrophosphate, thallium orthophosphate, platinum pyrophosphate, silver orthophosphate, silver pyrophosphate, nickel orthophosphate, lead pyrophosphate, chromium orthophosphate, manganese metaphosphate, copper orthophosphate, molybdenum metaphosphate, thorium orthophosphate, silver metaphosphate, tin orthophosphate, thallium pyrophosphate, tin pyrophosphate, tin metaphosphate and combinations thereof.

27. The aqueous suspension comprising from 95 to 20 percent by weight of water and from 5 to 80 percent by weight of said solid high-temperature lubricant of claim 16.

28. The aqueous solution of claim 27 wherein up to 0.5 percent by weight of a wetting agent is present, said wetting agent being selected from the group consisting of an alkyl aryl sulfonate, a fatty acid amine, a fatty acid soap, a substituted amide of alkyl phosphate, a sulfonated ester of dicarboxylic acid, a sulfonated fatty amide, an alkylolamine, a sodium alkyl sulfate, an aliphatic ester amine, a polyether, a sulfonated high phenol and a naphthalene sulfonate.

29. The process of producing the aqueous suspension of the high-temperature lubricant of claim 27 which comprises (a) preparing a dry admixture of said homopolymer or copolymer, said graphite, said film stabilizer and said dispersing agent, and (b) suspensing said dry admixture in water.

30. The process of lubricating metals during hot-working of said metal which comprises contacting the metal workpiece or tool to be hot-worked with the aqueous suspension of claim 27.

31. The process of claim 30 wherein said aqueous suspension of said high-temperature lubricant is used for lubricating pass rolling mills.

* * * * *